US009797696B2

(12) United States Patent
Golloher et al.

(10) Patent No.: US 9,797,696 B2
(45) Date of Patent: Oct. 24, 2017

(54) CONIC TAPER TIP FRACTURING PROJECTILES

(71) Applicant: OATH Corporation, Merritt Island, FL (US)

(72) Inventors: David Martin Golloher, Merritt Island, FL (US); Leonard William Terkeurst, Cocoa, FL (US)

( * ) Notice: Subject to any disclaimer, the term of this patent is extended or adjusted under 35 U.S.C. 154(b) by 84 days.

(21) Appl. No.: 14/625,097

(22) Filed: Feb. 18, 2015

(65) Prior Publication Data

US 2016/0265889 A1 Sep. 15, 2016

Related U.S. Application Data

(60) Provisional application No. 62/037,267, filed on Aug. 14, 2014.

(51) Int. Cl.
*F42B 12/34* (2006.01)
*F42B 12/24* (2006.01)

(52) U.S. Cl.
CPC ..... *F42B 12/34* (2013.01); *F42B 12/24* (2013.01)

(58) Field of Classification Search
CPC ..... F42B 30/02; F42B 12/34
USPC ..... 102/501, 506–510, 516, 517
See application file for complete search history.

(56) References Cited

U.S. PATENT DOCUMENTS 4,245,557 A 1/1981 Knappworst et al.
4,307,666 A * 12/1981 Baran ..... F42B 14/02 102/501
4,655,140 A 4/1987 Schirneker
4,665,827 A * 5/1987 Ellis, II ..... F42B 12/34 102/510
5,058,503 A * 10/1991 Adams, III ..... F42B 30/08 102/439
5,208,424 A 5/1993 Schluckebier et al.
5,339,743 A 8/1994 Scarlata
5,357,866 A 10/1994 Schluckebier et al.
5,811,723 A 9/1998 Stone
6,115,894 A 9/2000 Huffman
(Continued)

FOREIGN PATENT DOCUMENTS

WO 2014018144 1/2014

OTHER PUBLICATIONS

International Search Report and Written Opinion for related International application No. PCT/US15/45286.

*Primary Examiner* — Michael David
(74) *Attorney, Agent, or Firm* — Thomas|Horstemeyer, LLP.

(57) ABSTRACT

Various embodiments of projectiles are described. In one embodiment, a projectile includes a projectile core having a central recess formed therein, the central recess including a conical recess portion and a cylindrical recess portion. According to certain aspects, the projectile core may include a core base, and the central recess of the projectile core may extend from a leading circumferential rim of the projectile core to the core base along an axis of symmetry of the projectile core. The projectile core may further include projectile fingers each separated by a kerf, extending longitudinally from the core base to the leading circumferential rim, and extending radially apart from the axis of symmetry between an outer periphery of the central recess to an outer periphery surface of the core, and a nylon tip including a spherical nose, a conical taper portion, and a cylindrical anchor pin.

16 Claims, 19 Drawing Sheets

(56) References Cited

U.S. PATENT DOCUMENTS

| | | | | |
|---|---|---|---|---|
| 6,182,574 | B1 * | 2/2001 | Giannoni | F42B 12/34 102/510 |
| 6,581,522 | B1 | 6/2003 | Julien et al. | |
| 6,776,101 | B1 | 8/2004 | Pickard | |
| 8,789,470 | B2 * | 7/2014 | Frank | F42B 7/10 102/506 |
| 9,157,711 | B2 * | 10/2015 | Tresserras Torre | F42B 6/10 |
| 2002/0056397 | A1 | 5/2002 | Carr et al. | |
| 2003/0041768 | A1 * | 3/2003 | Rastegar | F41J 2/00 102/517 |
| 2003/0167954 | A1 | 9/2003 | Baumgartner et al. | |
| 2008/0314280 | A1 | 12/2008 | Martini Filho | |
| 2012/0090492 | A1 | 4/2012 | Rebar | |
| 2012/0111220 | A1 | 5/2012 | King | |
| 2012/0199035 | A1 | 8/2012 | Frank | |
| 2012/0272855 | A1 * | 11/2012 | Rebar | F42B 12/34 102/517 |
| 2013/0312631 | A1 | 11/2013 | Rossmann et al. | |
| 2015/0330751 | A1 * | 11/2015 | Flint | F42B 12/367 102/507 |

* cited by examiner

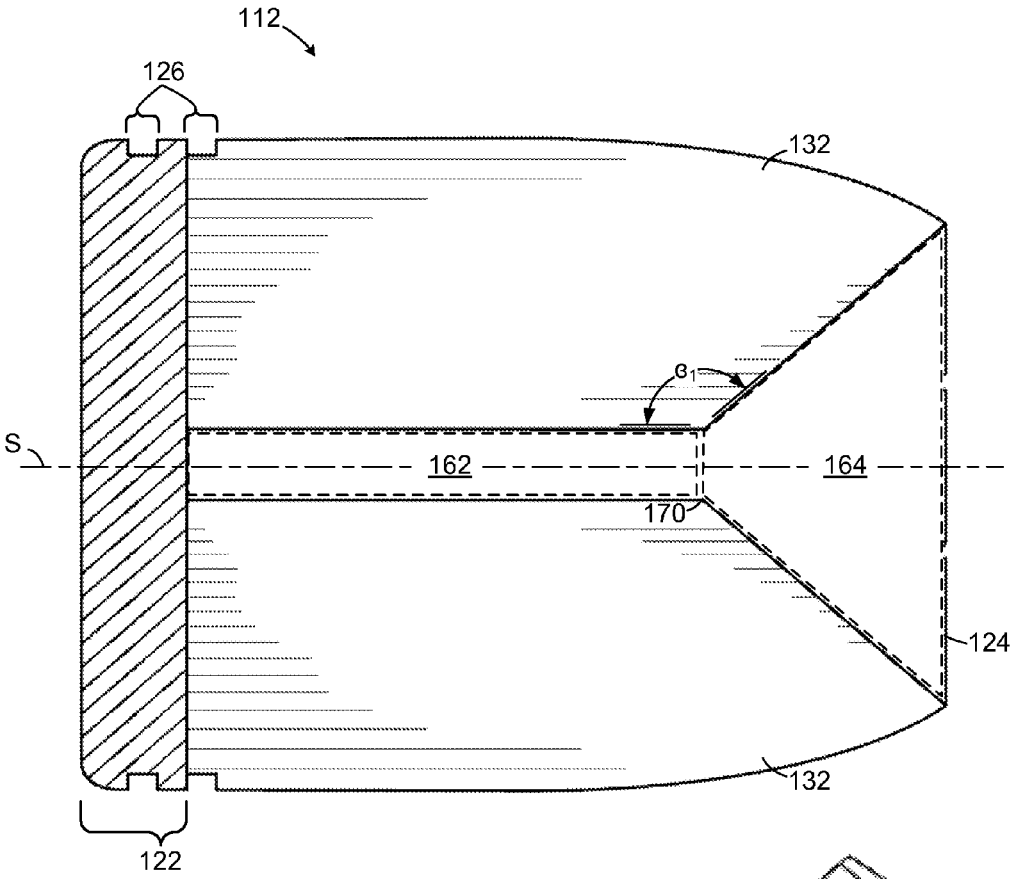
FIG. 1F
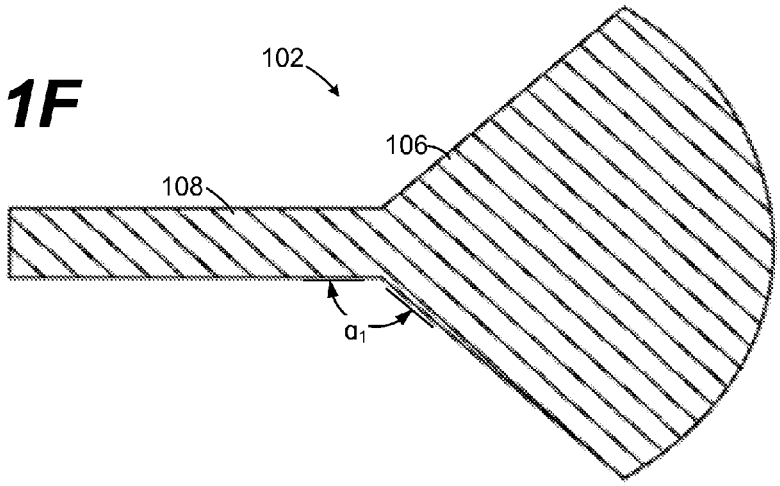

CONIC TAPER TIP FRACTURING PROJECTILES

CROSS-REFERENCE TO RELATED APPLICATIONS

This application claims the benefit of U.S. Provisional Application No. 62/037,267, filed Aug. 14, 2014, the entire contents of which is hereby incorporated herein by reference.

BACKGROUND

Firearms generally launch projectiles propelled by explosive force. Such firearms may be equipped with a barrel having an internal diameter defined by a common projectile caliber. A projectile used in conjunction with a firearm will have an external diameter that substantially matches the caliber of the barrel of the firearm. A person using a firearm may desire specific results when firing the weapon. To this end, a projectile may be designed to affect its ballistic or impact characteristics.

BRIEF DESCRIPTION OF THE DRAWINGS

For a more complete understanding of the embodiments described herein and the advantages thereof, reference is now made to the following description, in conjunction with the accompanying drawings briefly described as follows:

FIG. 1F illustrates a central recess of the projectile in the cross section A-A identified in FIG. 1C.

Figure 1A:
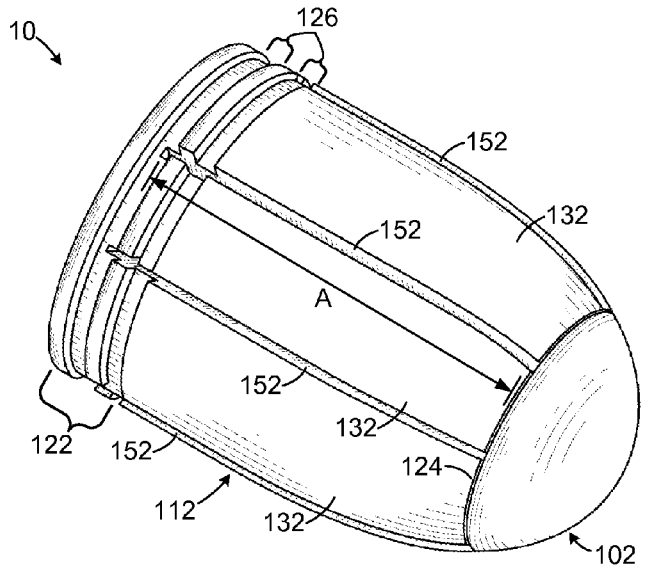
FIG. 1A illustrates a front perspective view of a projectile according to one example embodiment.

The drawings illustrate only example embodiments and are not to be considered limiting of the scope of the embodiments described herein, as other equivalents are within the scope and spirit of the disclosure. In the drawings, similar reference numerals between figures designate like or corresponding, but not necessarily the same, elements.

DETAILED DESCRIPTION

FIG. 1A illustrates a front perspective view of a projectile 10 according to one example embodiment. As illustrated, the projectile 10 includes a tip 102 and a projectile core 112. The projectile 10 in FIG. 1A may be similar in sizing or proportions to the commercially-recognized .450 Automatic Colt Pistol (ACP) caliber projectile. However, among embodiments, the projectile 10 may be embodied as a projectile of another commercially-recognized caliber, including but not limited to 9 millimeter, .40 Smith & Wesson, .380 ACP, or .357 Magnum, among other commercially-recognized or custom calibers. It should be appreciated that the shape, size, dimensions, and proportions of the projectile 10 in FIGS. 1A-G are not necessarily drawn precisely to scale and should not be considered to limit or define the scope of the embodiments described herein. Further, no casing is illustrated in FIG. 1A, but it should be appreciated that the projectile 10 (and the other projectile embodiments described herein) may be relied upon as one part of a full cartridge including a projectile, a case or shell, powder, a primer, etc.

Among embodiments, the projectile core 112 may be formed from any material or materials suitable for the application, including a metal, a composition of metals (e.g., metal alloys), rubber, plastics (e.g., polystyrene, polyvinyl chloride, nylon or other polymers), glass, other materials, or combinations thereof. In one embodiment, the projectile core 112 may be formed from a base of solid brass or bronze stock material. In another embodiment, the projectile core 112 may be formed from a base of solid copper stock material. The solid brass, bronze, or copper stock material may lack certain elements, such as lead. In this sense, being made from an alloy of substantially copper, for example, and possibly including smaller proportions of one or more of zinc, tin, nickel, aluminum, etc., the projectile core 112 may be considered a "green" projectile or bullet in that it lacks lead and/or other elements which may be known to cause health or environmental concerns. In some embodiments, however, the projectile core 112 may be formed from a base of material or materials including lead and other elements. In at least the embodiments of solid copper, brass, or bronze, for example, the projectile core 112 would be formed without the need for a metal jacket.

The tip 102 may be formed from any material suitable for the application, including a metal, a composition of metals (e.g., metal alloys), rubber, plastics (e.g., polystyrene, polyvinyl chloride, nylon or other polymers), glass, other materials, or combinations thereof. The tip 102 may be sized to fit snugly into a central recess within the projectile core 112 and be retained therein by way of friction, compression, or other mechanical affixation. If desired, an adhesive may be further relied upon to secure the tip 102 within the central recess of the projectile core 112.

As further described below with reference to FIG. 1D, the tip 102 may act as a type of lever to expand fingers of the projectile core 112 upon impact of the projectile 10 with a surface or body. Further, as hollow point bullets may jam on the barrel ramp to the barrel, they may have problems being chambered into a gun, especially after an initial shot is made. In this context, the tip 102 may also help to insure a smooth feed into the barrel of a gun. In some embodiments, however, the tip 102 may be omitted and the projectile core 112 used without the tip 102.

Referring again to FIG. 1A, the projectile core 112 includes a core base 122 (see also FIGS. 1F and 1G), undercuts 126, and projectile fingers 132 separated from each other by kerfs 152. Certain aspects of the core base 122 are described in further detail below with reference to FIG. 1H. The undercuts 126 may be included to facilitate suitable splintering or fracturing of the projectile fingers 132 apart from each other after impact of the projectile 10, although one or both of the undercuts 126 may be omitted.

In the embodiment illustrated in FIG. 1A, the projectile 10 includes six projectile fingers 132, although other numbers of projectile fingers are within the scope of the embodiments. The number of projectile fingers 132 may depend upon the caliber of the projectile 10, for example, among other factors. As described in greater detail below with reference to FIG. 1D, the projectile fingers 132 extend (e.g., occupy the space) radially apart from an axis of symmetry of the projectile core 112 between an outer periphery of a central recess of the projectile core 112 to an outer periphery of the projectile core 112. Further, the projectile fingers 132 extend longitudinally from the leading circumferential rim 124 of the projectile core 112 to the core base 122. The leading circumferential rim 124 may be considered the meplat of the projectile core 112 but is not necessarily the most forward reaching point of the projectile 10. Rather, in the embodiments which include it, the tip 102 is the most forward reaching point of the projectile 10.

In the illustrated embodiment, each kerf 152 extends the distance "A" from the leading circumferential rim 124 to the core base 122 (or near the core base 122) of the projectile core 112. The distance "A" that the kerfs 152 extend may vary among embodiments, but the kerfs 152 generally extend from the leading circumferential rim 124 substantially to or toward the core base 122 (or the back end of the projectile core 112). In other embodiments, one or more of the kerfs 152 may extend a first distance while one or more others extend other distances. In the embodiments which include one or more undercuts 126, the kerfs 152 may extend from the leading circumferential rim 124, to or toward the core base 122, and entirely or partially across one or more of the undercuts 126.

Figure 1B:
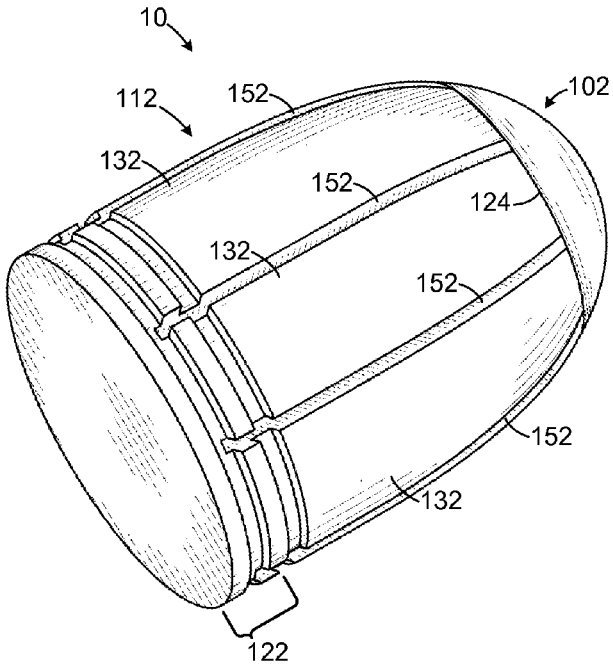
FIG. 1B illustrates a back perspective view of the projectile in FIG. 1A.

FIG. 1B illustrates a back perspective view of the projectile 10 in FIG. 1A. In FIG. 1B, it can be seen that the back side of the projectile 10 is substantially flat. In other embodiments, the back side of the projectile 10 may be formed into a concave semispherical-shaped recess to permit the projectile core 112 to more easily splinter or fracture upon impact of the projectile 10, to adjust the ballistics of the projectile 10, to adjust the overall weight of the projectile 10, or for other reasons.

Figure 1C:
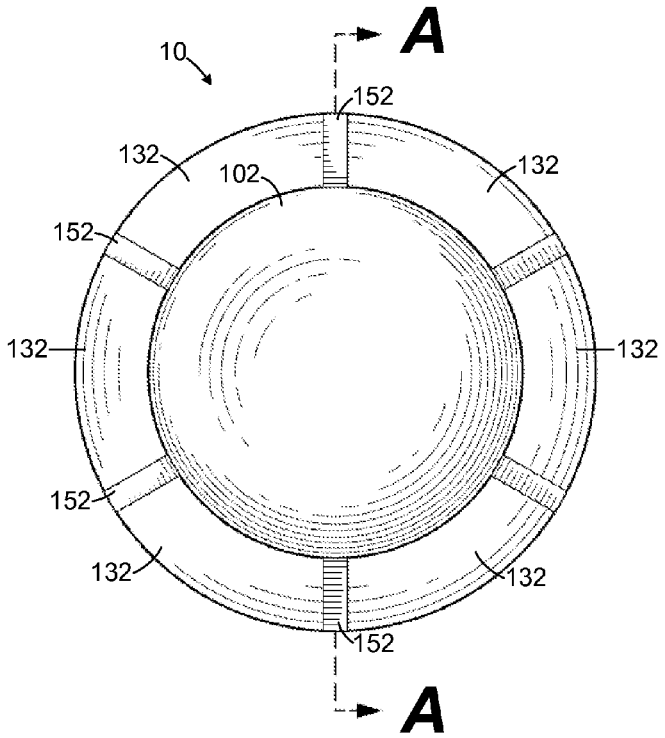
FIG. 1C illustrates a front view of the projectile in FIG. 1A.
Figure 1D:
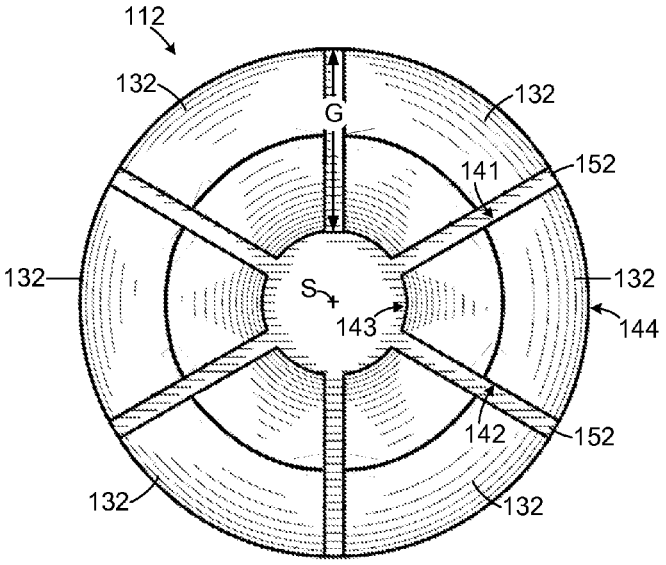
FIG. 1D illustrates a front view of the projectile core of the projectile in FIG. 1A.

FIG. 1C illustrates a front view of the projectile 10 in FIG. 1A. In FIG. 1C, along with the tip 102, each of the six projectile fingers 132 can be seen with the kerfs 152 separating the projectile fingers 132. Turning to FIG. 1D, a front view of the projectile core 112 is illustrated. As compared to FIG. 1C, the tip 102 of the projectile 10 is omitted from view in FIG. 1D. Thus, in FIG. 1D, it can be seen that the projectile fingers 132 include several surfaces. Surfaces 141-144 of one of the projectile fingers 132 are referenced in FIG. 1D. The surfaces 141 and 142, which are formed along the kerfs 152, are substantially flat, and the surfaces 143 and 144 are curved. Further, it is clear that the projectile fingers 132 extend the distance "G" radially away from the axis of symmetry "S" (see also FIG. 1G) from the inner curved surface 143 to the outer curved surface 144. In other words, the projectile fingers 132 extend radially away from the axis of symmetry "S" between the central recess of the projectile core 112 to an outer periphery of the projectile core 112.

Figure 1E:
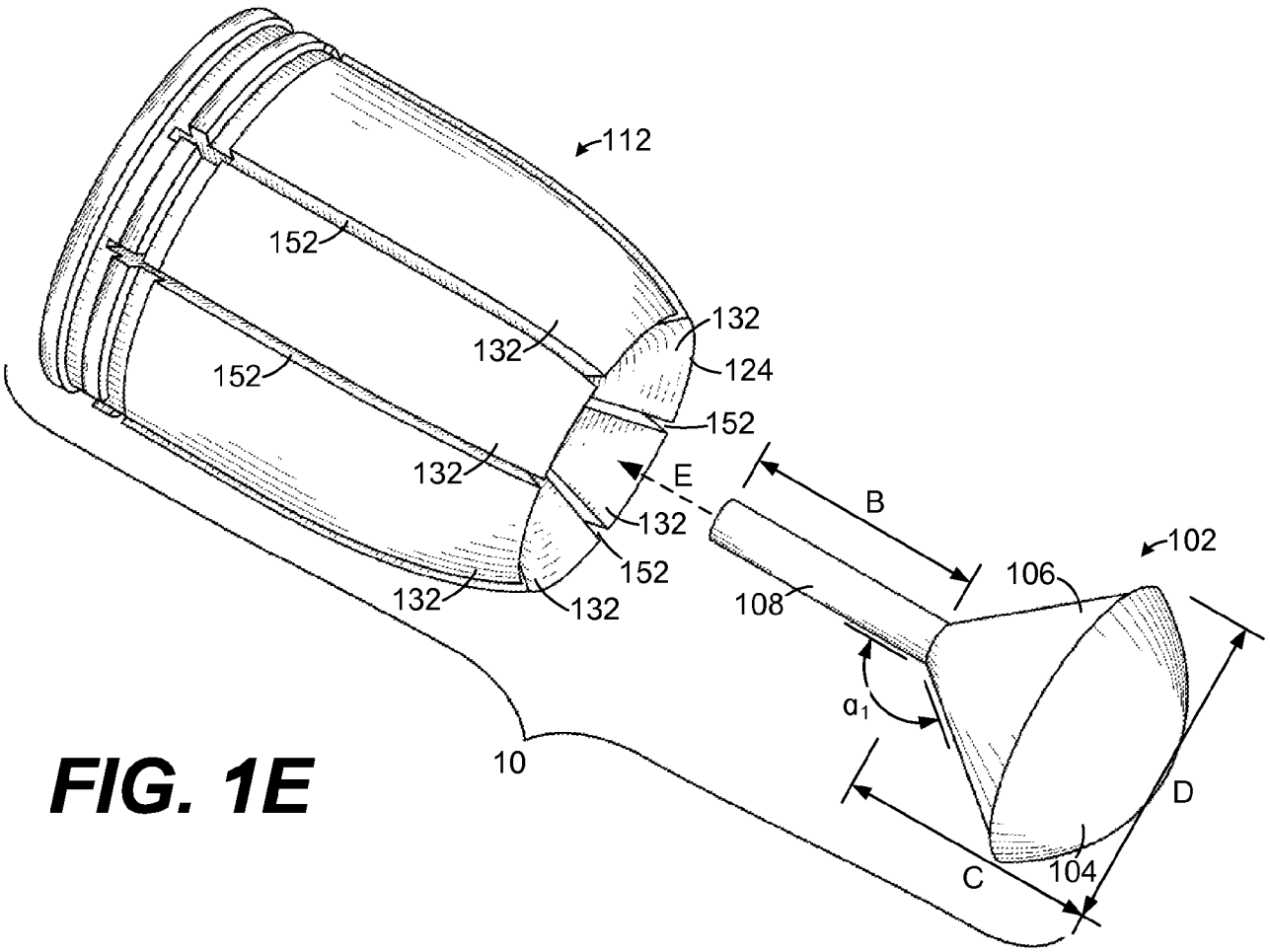
FIG. 1E illustrates a front perspective exploded view of the projectile in FIG. 1A.

Turning to FIG. 1E, a front perspective exploded view of the projectile 10 in FIG. 1A is illustrated. In FIG. 1E, the tip 102 is removed from the projectile core 112 and the features of the tip 102 are illustrated in further detail. The tip 102 includes a semispherical-shaped nose 104, a conical taper portion 106, and a cylindrical anchor pin 108. Generally, the shape of the tip 102 corresponds to or mates with the central recess within the projectile core 112, as further described below with reference to FIG. 1F. The length "B" of the cylindrical anchor pin 108 may vary among embodiments. In one embodiment, the cylindrical anchor pin 108 may be formed to have sufficient length "B" so as to have enough surface area to fit snugly into the central recess within the projectile core 112 and be retained therein by way of friction, but other considerations may be accounted for. The length "C" and the width "D" of the conical taper portion 106 may also vary among embodiments.

It should be appreciated that, the angle $\alpha_1$ between the surfaces of the cylindrical anchor pin 108 and the conical taper portion 106 may be selected based in part on the tensile strength of the material from which the projectile core 112 is formed, for example, as one factor to help ensure that the projectile fingers 132 splinter or fracture at the appropriate moment after impact of the projectile 10. The conical taper portion 106 may meet the cylindrical anchor pin 108 at an angle $\alpha_1$ of about 115 to 165 degrees, for example, between a surface of the conical taper portion 106 and a surface of the cylindrical anchor pin 108.

With regard to splintering or fracturing the projectile fingers 132 apart, it is noted that one primary purpose and function of the tip 102 is to facilitate the suitable splintering or fracturing of the projectile fingers 132 after impact of the projectile 10. Upon impact of the tip 102 of the projectile 10 with any surface or body, the tip 102 will be pressed further into the central recess within the projectile core 112 in the direction "E". At the same time, the conical taper portion 106 of the tip 102 will apply upon the projectile fingers 132 a component of force (at least in part) perpendicular to the axis of symmetry "S" (see FIG. 1G) of the projectile 10. In turn, the projectile fingers 132 will bear a force tending to splinter or fracture the projectile fingers 132 apart from each other. An additional description of how the projectile 10 fractures upon impact, rather than deforms, is provided below with reference to FIG. 1H.

FIG. 1F illustrates the cross section A-A identified in FIG. 1C. In FIG. 1F, the central recess of the projectile 10 is outlined. The central recess includes a cylindrical recess portion 162 and a conical recess portion 164. When assembled, the cylindrical anchor pin 108 of the tip 102 (FIG. 1E) is inserted into and occupies at least part of the cylindrical recess portion 162, and the conical taper portion 106 of the tip 102 fits within and occupies at least part of the conical recess portion 164.

As shown in FIG. 1F, the profile of the inside surfaces of the projectile fingers 132 track the axis of symmetry "S" of the projectile 10 along the cylindrical recess portion 162, but makes a corner at the transition point 170 between the cylindrical recess portion 162 and the conical recess portion 164. At the transition point 170, the inside surfaces of the projectile fingers 132 turn at the angle $\beta_1$ with respect to the axis of symmetry "S" and continue for a second distance to the leading circumferential rim 124. As illustrated, the sharpness of the cornered transition point 170 is determined by the angle $\beta_1$. The angle $\beta_1$ between the cylindrical recess portion 162 and the conical recess portion 164 (and the corresponding angle $\alpha_1$ in the tip 102) may be selected based in part on the tensile strength of the material from which the projectile core 112 is formed, for example, to see that the projectile fingers 132 splinter or fracture at the appropriate moment after impact of the projectile 10.

Figure 1G:
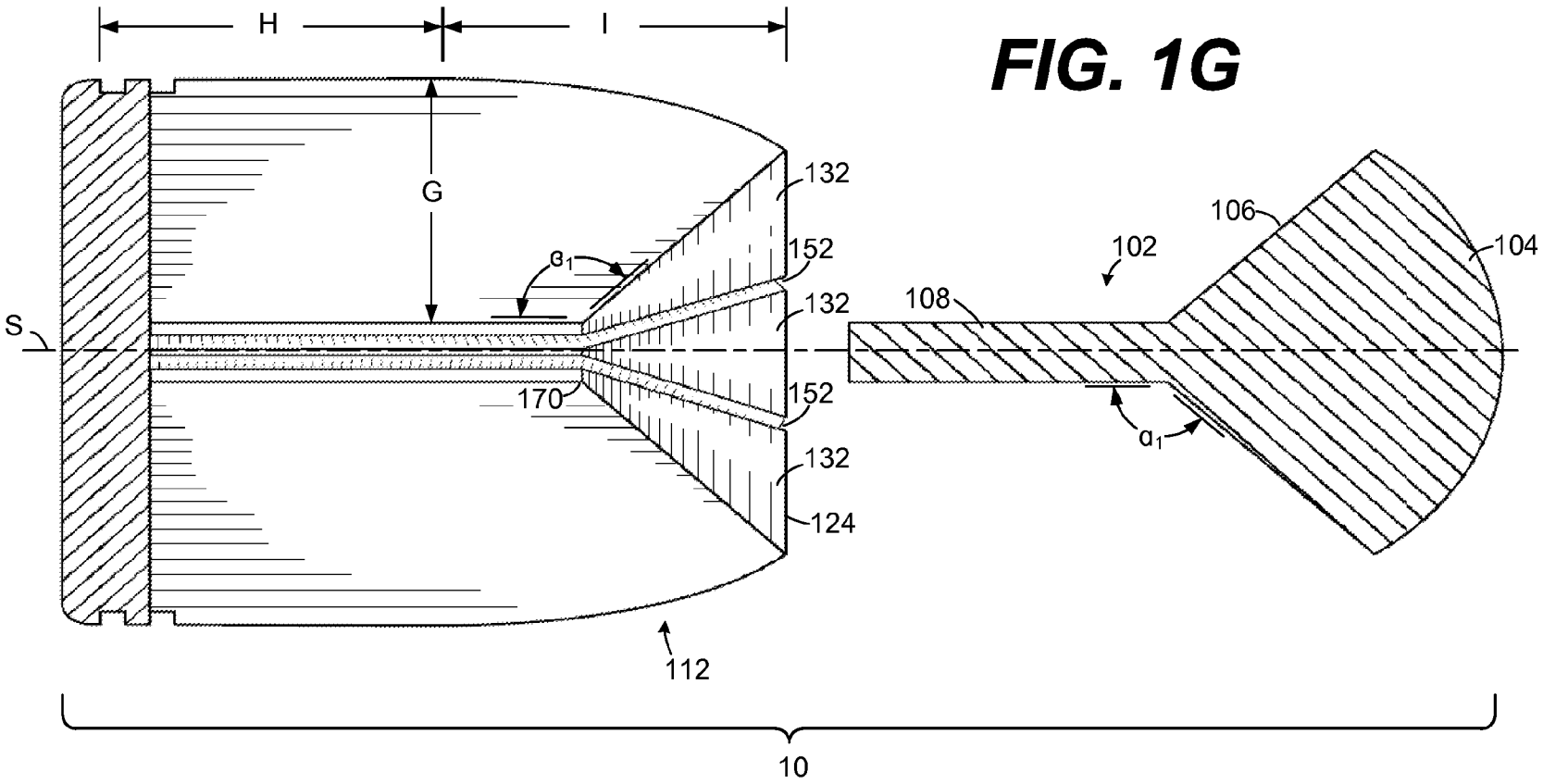
FIG. 1G illustrates another view of the cross section A-A of the projectile identified in FIG. 1C.

FIG. 1G illustrates another view of the cross section A-A of the projectile 10 identified in FIG. 1C. In FIG. 1G, the axis of symmetry "S" of the projectile 10 and the profile of the projectile fingers 132 are shown. The length "H" of the bearing surface and the length "I" of the ogive surface of the projectile core 112 are also shown. Among preferred embodiments, the projectile core 112 may be formed such that the core base 122 is relatively small. For example, along the axis of symmetry, the core base 122 may extend less than between thirty to ten percent of the total length of the projectile core 112. Thus, when the projectile fingers 132 splinter or fracture, no slug portion of the projectile 10 may remain. In other words, as detailed below with reference to FIG. 1H, when the projectile fingers 132 splinter or fracture, the core base 122 splinters or fractures into sections along with the projectile fingers 132, without any slug (e.g., from the core base 122) remaining.

Figure 1H:
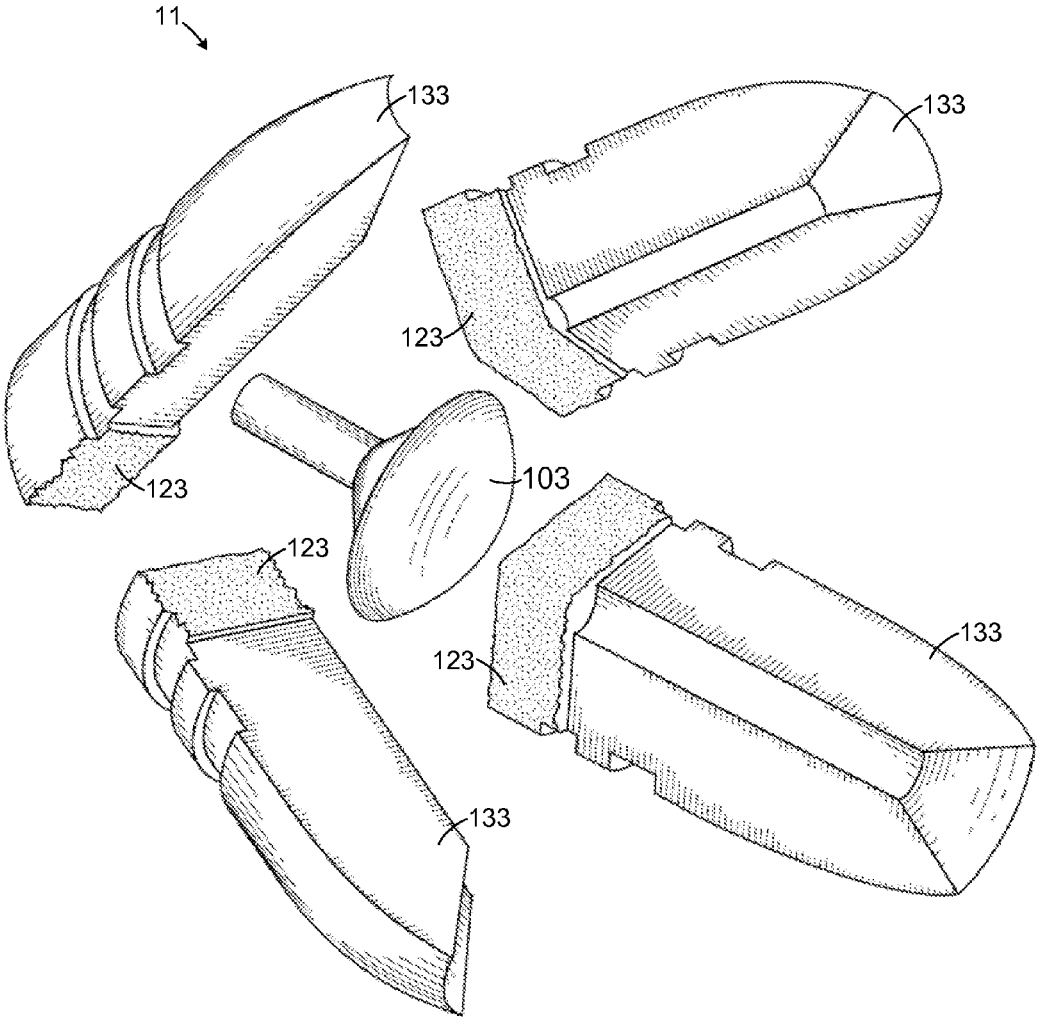
FIG. 1H illustrates a representative fractured perspective view of a projectile according to aspects of the embodiments.

FIG. 1H illustrates a representative fractured perspective view of a projectile 11 according to aspects of the embodiments. The projectile 11 includes four projectile fingers 133 and a tip 103. At the time of impact, the tip 103 is pressed further into the central recess of the projectile core and acts as a type of lever to expand the projectile fingers 133. When expanded, the projectile fingers 133 splinter or fracture apart, as illustrated, dividing the core base into sections along the fractured edges 123 without any slug remaining. Thus, after the projectile core splinters or fractures into sections, the momentum of the projectile 11 is transferred, in parts, to the projectile fingers 133.

As compared to many conventional projectiles, certain embodiments of the projectiles described herein are designed to be substantially non-deforming after impact. In other words, rather than bending, deforming, or mushrooming after impact, the projectile fingers of the projectiles described herein fracture apart but otherwise avoid deforming or changing shape. The non-deforming nature may be attributed to several factors including the materials from which the projectiles are formed (e.g., hard, but brittle), the length of the kerfs, the relatively small size of the core base, and the lever action provided by the tip after impact.

In other embodiments, the projectiles described herein may both fracture apart and partially deform before and/or after fracturing. In this case, the projectile fingers fracture apart and (at least to some extent) bend, deform, or mushroom after impact. This semi-deforming nature may be attributed to several factors including the materials from which the projectiles are formed (e.g., relatively hard), the length of the kerfs, the relatively small size of the core base, and the lever action provided by the tip after impact. In still other embodiments, the projectiles may deform without fracturing. This deforming nature may be attributed to several factors including the materials from which the projectiles are formed (e.g., relatively soft), the length of the kerfs, the relatively small size of the core base, and the lever action provided by the tip after impact.

Figure 2A:
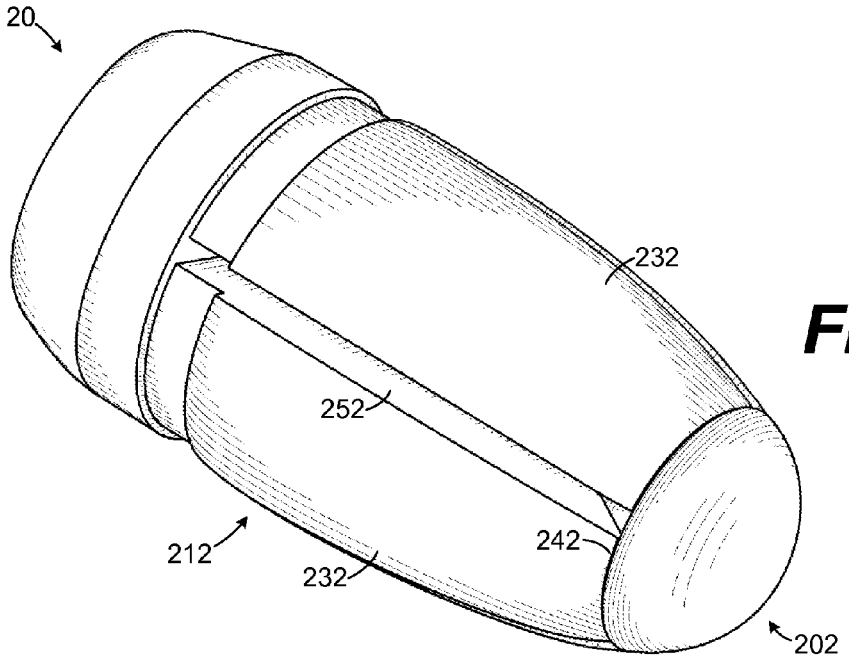
FIGS. 2A-D illustrate front perspective, back perspective, front, and front perspective exploded views of a projectile, respectively, according to another example embodiment.
Figure 2B:
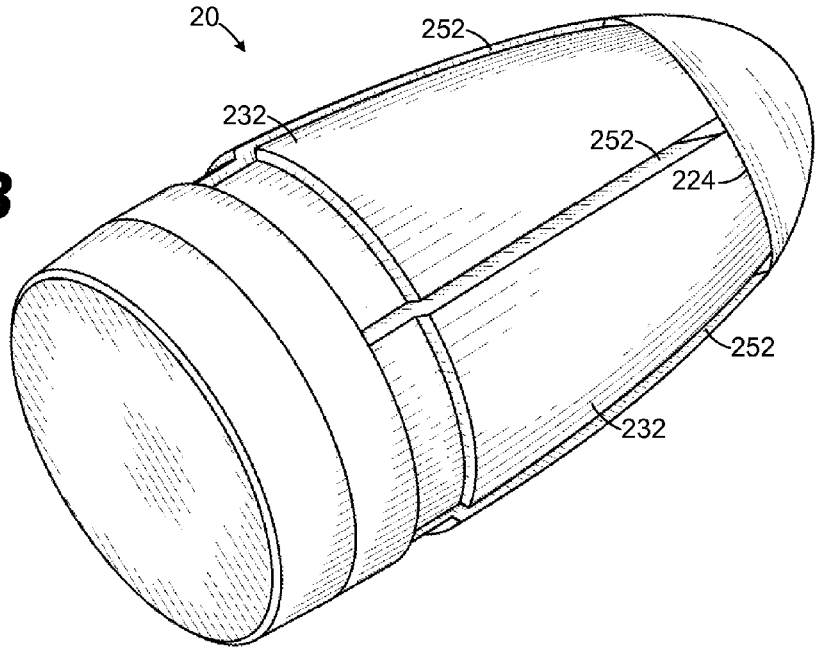
Figure 2C:
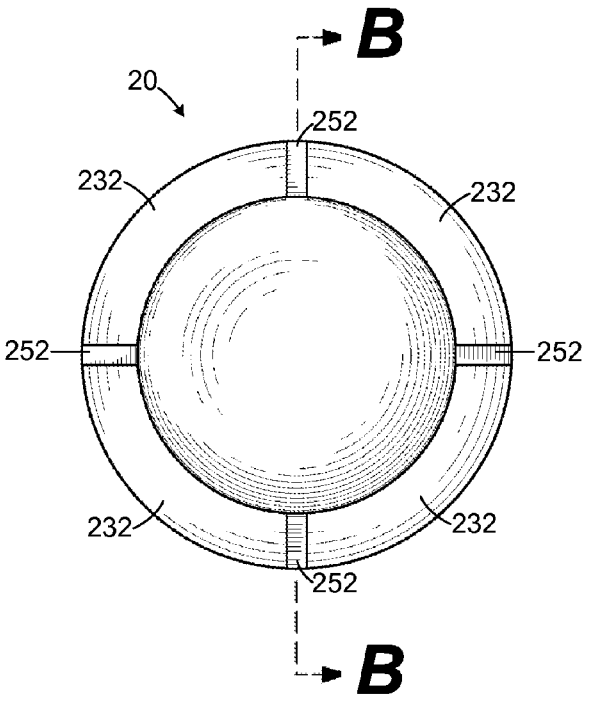
Figure 2D:
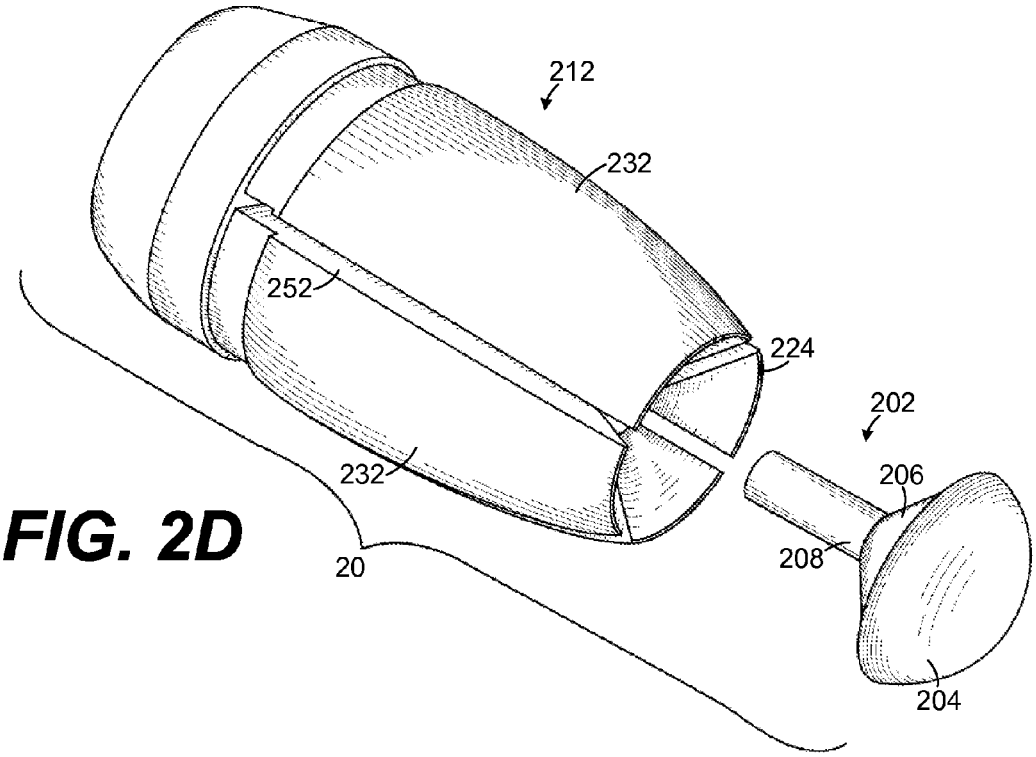
Figure 2E:
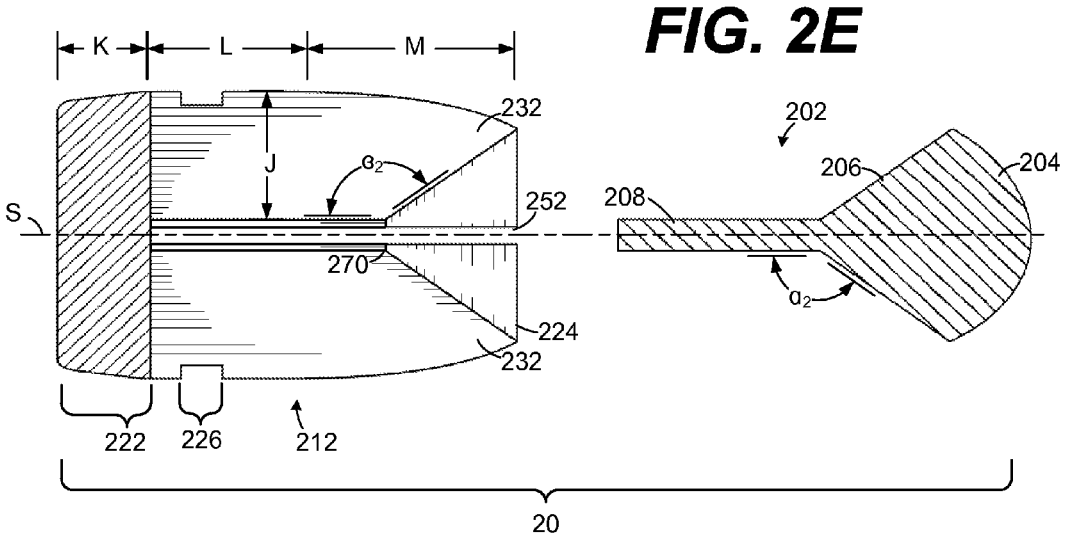
FIG. 2E illustrates a view of the cross section B-B identified in FIG. 2C.

FIGS. 2A-D illustrate front perspective, back perspective, front, and front perspective exploded views of a projectile 20, respectively, according to another example embodiment, and FIG. 2E illustrates a view of the cross section B-B identified in FIG. 2C. As shown among FIGS. 2A-E, the projectile 20 includes a tip 202 and a projectile core 212. The projectile 20 may be similar in sizing or proportions to the commercially-recognized 9 millimeter caliber projectile. However, among embodiments, the projectile 20 may be embodied as a projectile of another commercially-recognized caliber, including but not limited to .450 Automatic Colt Pistol (ACP), .40 Smith & Wesson, .380 ACP, or .357 Magnum, among other commercially-recognized or custom calibers. It should be appreciated that the shape, size, dimensions, and proportions of the projectile 20 in FIGS. 2A-E are not necessarily drawn precisely to scale and should not be considered to limit or define the scope of the embodiments described herein. The projectile core 212 may be formed from any material or materials suitable for the application, including but not limited to those described above for the projectile core 112 in FIG. 1A. The tip 202 may also be formed from any material suitable for the application, including but not limited to those described above for the tip 102 in FIG. 1A.

Referring among FIGS. 2A-E, the projectile core 212 includes a core base 222 (FIG. 2E), an undercut 226, and projectile fingers 232 separated from each other by kerfs 252. As compared to the projectile 10, the projectile 20 includes four projectile fingers 232 rather than six. The undercut 226 may be included to facilitate suitable splintering or fracturing of the projectile fingers 232 apart from each other after impact of the projectile 20, although it may be omitted.

As illustrated among FIGS. 2A-E, each kerf 252 extends from the leading circumferential rim 224 substantially to the core base 222 (or near the core base 222) of the projectile core 212. The kerfs 252 may extend from the leading circumferential rim 224, to or toward the core base 222, and entirely or partially across the undercut 226. The distance that the kerfs 252 extend may vary, but the kerfs 252 generally extend deep enough into the projectile core 212 so that the projectile core 212 will fracture apart upon impact of the projectile 20, without leaving any remaining slug.

Referring to FIG. 2D, the tip 202 is removed from the projectile core 212 and the features of the tip 202 are illustrated in further detail. According to the concepts described herein, the tip 202 may act as a type of lever to expand fingers of the projectile core 212 upon impact of the projectile 20 with a surface or body. The tip 202 includes a semispherical-shaped nose 204, a conical taper portion 206, and a cylindrical anchor pin 208. Generally, the shape of the tip 202 corresponds to or mates with the central recess within the projectile core 212. The length of the cylindrical anchor pin 208 may vary among embodiments. In one embodiment, the cylindrical anchor pin 208 may be formed to have sufficient length to fit snugly into the central recess within the projectile core 212 and be retained therein by way of friction, but other considerations may be accounted for.

FIG. 2E illustrates the cross section B-B identified in FIG. 2C. In FIG. 2E, the central recess of the projectile 20 is visible. As shown, the central recess of the projectile core 212 includes a cylindrical recess portion and a conical recess portion. As described above, when assembled, the cylindrical anchor pin 208 of the tip 202 is inserted into and occupies at least part of the cylindrical recess portion, and the conical taper portion 206 of the tip 202 fits within and occupies at least part of the conical recess portion.

As also shown in FIG. 2E, the profile of the inside surfaces of the projectile fingers 232 track the axis of symmetry "S" of the projectile 20 along the cylindrical recess portion, but makes a corner at the transition point 270 between the cylindrical recess portion and the conical recess portion. At the transition point 270, the inside surfaces of the projectile fingers 232 turn at the angle $\beta_2$ with respect to the axis of symmetry "S" and continue for a second distance to the leading circumferential rim 224. As illustrated, the sharpness of the cornered transition point 270 is determined by the angle $\beta_2$. The angle $\beta_2$ between the cylindrical recess portion and the conical recess portion (and the corresponding angle $\alpha_2$ in the tip 202) may be selected based in part on the tensile strength of the material from which the projectile core 212 is formed, for example, to see that the projectile fingers 232 splinter or fracture at the appropriate moment after impact of the projectile 20.

The projectile fingers 232 extend (e.g., occupy the space) radially apart from the axis of symmetry "S" the distance "J" between the central recess of the projectile core 212 and an outer periphery of the projectile core 212. Further, the projectile fingers 232 extend longitudinally from the leading circumferential rim 224 of the projectile core 212 to the core base 222. The leading circumferential rim 224 may be considered the meplat of the projectile core 212 but is not necessarily the most forward reaching point of the projectile 20. Rather, in the embodiments which include it, the tip 202 is the most forward reaching point of the projectile 20.

The length "K" of the boat tail, the length "L" of the bearing surface, and the length "M" of the ogive surface of the projectile core 212 are also shown in FIG. 2E. The individual and relative lengths of the boat tail, the bearing surface, and the ogive surface of the projectile core 212 may vary from that shown. In one embodiment, the projectile core 212 may be formed such that the core base 222 is relatively small.

Similar to the case discussed above with reference to FIG. 1H, upon impact of the tip 202 of the projectile 20 with any surface or body, the tip 202 will be pressed further into the central recess within the projectile core 212. At the same time, the conical taper portion 206 of the tip 202 will apply upon the projectile fingers 232 a component of force (at least in part) perpendicular to the axis of symmetry "S" of the projectile 20. In turn, the projectile fingers 232 will bear a force tending to splinter or fracture the projectile fingers 232 apart from each other. When the projectile fingers 232 splinter or fracture, no slug portion of the projectile 20 remains. Instead of a slug remaining, the core base 222 splinters or fractures into sections along with the projectile fingers 232. Thus, after the projectile core 212 splinters or fractures into sections, the momentum of the projectile 20 is transferred, in parts, to the projectile fingers 232.

It should be appreciated that the angle $\alpha_2$ between the surfaces of the cylindrical anchor pin 208 and the conical taper portion 206 may be selected based in part on the tensile strength of the material from which the projectile core 212 is formed, for example, as one factor to help ensure that the projectile fingers 232 splinter or fracture at the appropriate moment after impact of the projectile 20. The conical taper portion 106 may meet the cylindrical anchor pin 108 at an angle $\alpha_2$ of about 115 to 165 degrees, for example, between a surface of the conical taper portion 206 and a surface of the cylindrical anchor pin 208.

Figure 3A:
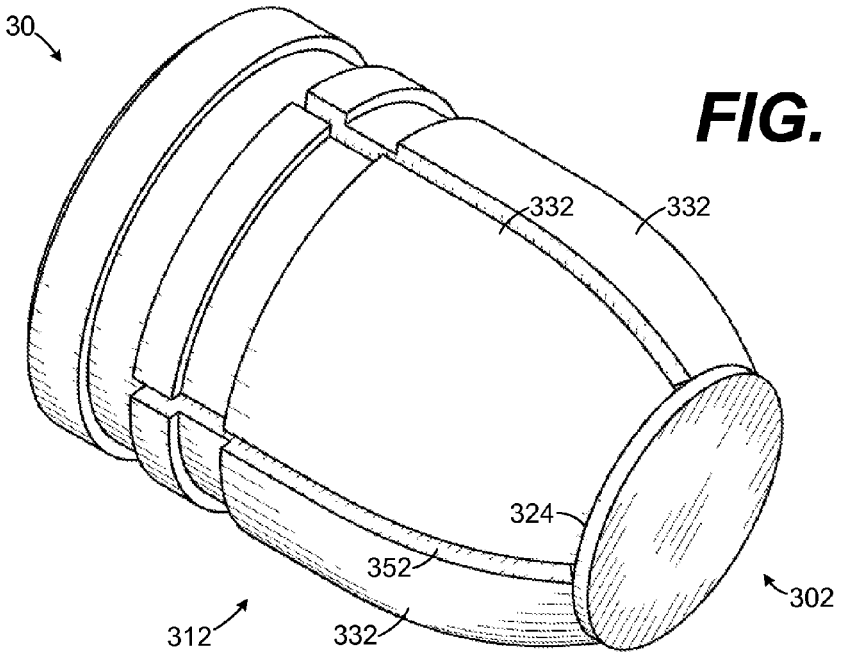
FIGS. 3A-D illustrate front perspective, back perspective, front, and front perspective exploded views of a projectile, respectively, according to another example embodiment.
Figure 3B:
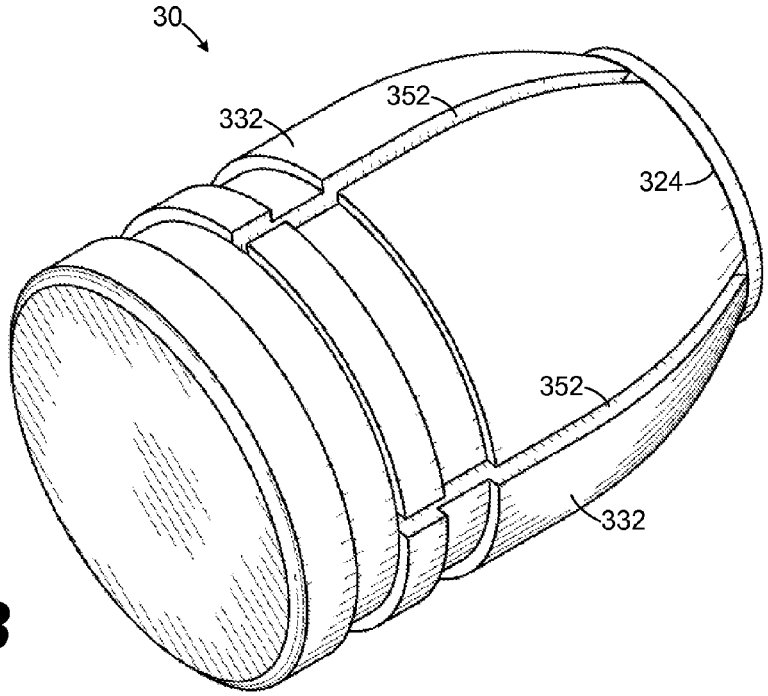
Figure 3C:
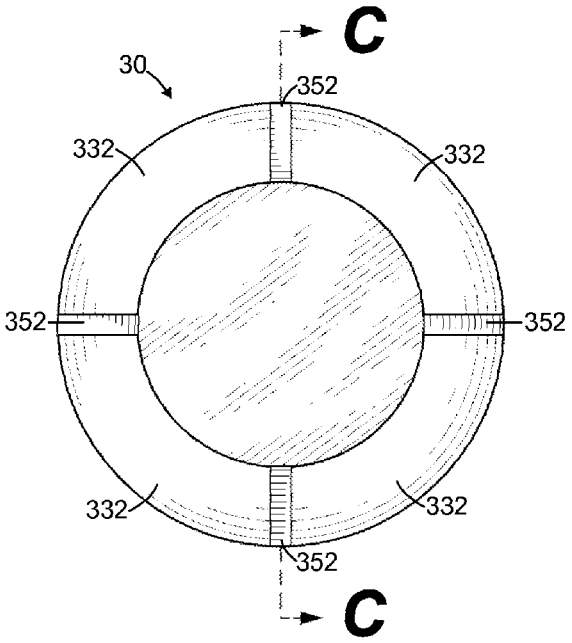
Figure 3D:
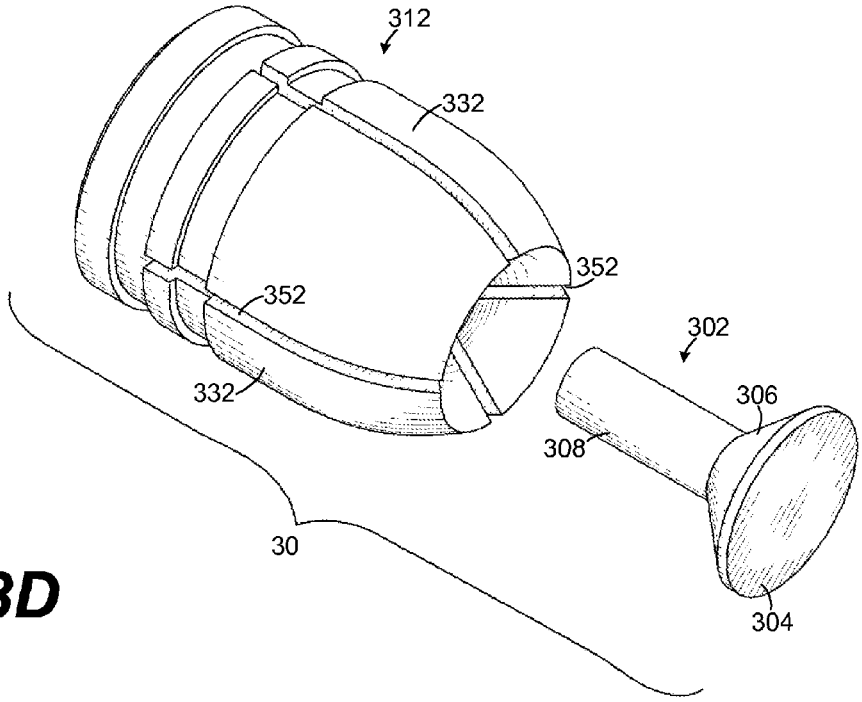
Figure 3E:
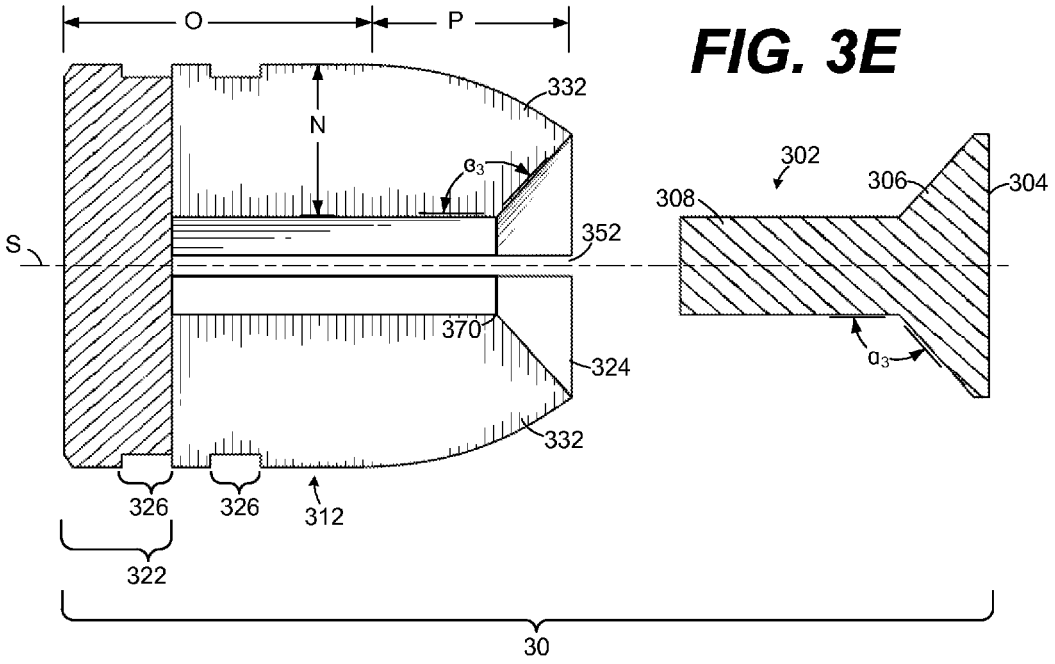
FIG. 3E illustrates a view of the cross section C-C identified in FIG. 3C.

FIGS. 3A-D illustrate front perspective, back perspective, front, and front perspective exploded views of a projectile 30, respectively, according to another example embodiment, and FIG. 3E illustrates a view of the cross section C-C identified in FIG. 3C. As shown among FIGS. 3A-E, the projectile 30 includes a tip 302 and a projectile core 312. The projectile 30 may be similar in sizing or proportions to the commercially-recognized .380 ACP caliber projectile. However, among embodiments, the projectile 30 may be embodied as a projectile of another commercially-recognized caliber, including but not limited to .450 Automatic Colt Pistol (ACP), 9 millimeter, .40 Smith & Wesson, or .357 Magnum, among other commercially-recognized or custom calibers. It should be appreciated that the shape, size, dimensions, and proportions of the projectile 30 in FIGS. 3A-E are not necessarily drawn precisely to scale and should not be considered to limit or define the scope of the embodiments described herein. The projectile core 312 may be formed from any material or materials suitable for the application, including but not limited to those described above for the projectile core 112 in FIG. 1A. The tip 302 may also be formed from any material suitable for the application, including but not limited to those described above for the tip 102 in FIG. 1A.

Referring among FIGS. 3A-E, the projectile core 312 includes a core base 322 (FIG. 3E), undercuts 326, and projectile fingers 332 separated from each other by kerfs 352. As compared to the projectile 10, the projectile 30 includes four projectile fingers 332 rather than six. The undercuts 326 may be included to facilitate suitable splintering or fracturing of the projectile fingers 332 apart from each other after impact of the projectile 30, although they may be omitted.

As illustrated among FIGS. 3A-E, each kerf 352 extends from the leading circumferential rim 324 substantially to the core base 322 (or near the core base 322) of the projectile core 312. The kerfs 352 may extend from the leading circumferential rim 324, to or toward the core base 322, and entirely or partially across the undercut 326. The distance that the kerfs 352 extend may vary, but the kerfs 352 generally extend deep enough into the projectile core 312 so that the projectile core 312 will fracture apart upon impact of the projectile 30, without leaving any remaining slug.

Referring to FIG. 3D, the tip 302 is removed from the projectile core 312, and the features of the tip 302 are illustrated in further detail. According to the concepts described herein, the tip 302 may act as a type of lever to expand fingers of the projectile core 312 upon impact of the projectile 30 with a surface or body. The tip 302 includes a flat-shaped nose 304, a conical taper portion 306, and a cylindrical anchor pin 308. Generally, the shape of the tip 302 corresponds to or mates with the central recess within the projectile core 312. The length of the cylindrical anchor pin 308 may vary among embodiments. In one embodiment, the cylindrical anchor pin 308 may be formed to have sufficient length to fit snugly into the central recess within the projectile core 312 and be retained therein by way of friction, but other considerations may be accounted for.

FIG. 3E illustrates the cross section C-C identified in FIG. 3C. In FIG. 3E, the central recess of the projectile 30 is visible. As shown, the central recess of the projectile core 312 includes a cylindrical recess portion and a conical recess portion. As described above, when assembled, the cylindrical anchor pin 308 of the tip 302 is inserted into and occupies at least part of the cylindrical recess portion, and the conical taper portion 306 of the tip 302 fits within and occupies at least part of the conical recess portion.

As also shown in FIG. 3E, the profile of the inside surfaces of the projectile fingers 332 track the axis of symmetry "S" of the projectile 30 along the cylindrical recess portion but makes a corner at the transition point 370 between the cylindrical recess portion and the conical recess portion. At the transition point 370, the inside surfaces of the projectile fingers 332 turn at the angle $\beta_3$ with respect to the axis of symmetry "S" and continue for a second distance to the leading circumferential rim 324. As illustrated, the sharpness of the cornered transition point 370 is determined by the angle $\beta_3$. The angle $\beta_3$ between the cylindrical recess portion and the conical recess portion (and the corresponding angle $\alpha_3$ in the tip 302) may be selected based in part on the tensile strength of the material from which the projectile core 312 is formed, for example, to see that the projectile fingers 332 splinter or fracture at the appropriate moment after impact of the projectile 30.

The projectile fingers 332 extend (e.g., occupy the space) radially apart from the axis of symmetry "S" the distance "N" between the central recess of the projectile core 312 and an outer periphery of the projectile core 312. Further, the projectile fingers 332 extend longitudinally from the leading circumferential rim 324 of the projectile core 312 to the core base 322. The leading circumferential rim 324 may be considered the meplat of the projectile core 312 but is not necessarily the most forward reaching point of the projectile 30. Rather, in the embodiments which include it, the tip 302 is the most forward reaching point of the projectile 30.

The length "O" of the bearing surface and the length "P" of the ogive surface of the projectile core 312 are also shown in FIG. 3E. The individual and relative lengths of the bearing surface and the ogive surface of the projectile core 312 may vary from that shown. In one embodiment, the projectile core 312 may be formed such that the core base 322 is relatively small.

Similar to the case discussed above with reference to FIG. 1H, upon impact of the tip 302 of the projectile 30 with any surface or body, the tip 302 will be pressed further into the central recess within the projectile core 312. At the same time, the conical taper portion 306 of the tip 302 will apply upon the projectile fingers 332 a component of force (at least in part) perpendicular to the axis of symmetry "S" of the projectile 30. In turn, the projectile fingers 332 will bear a force tending to splinter or fracture the projectile fingers 332 apart from each other. When the projectile fingers 332 splinter or fracture, no slug portion of the projectile 30 remains.

The angle $\alpha_3$ between the surfaces of the cylindrical anchor pin 308 and the conical taper portion 306 may be selected based in part on the tensile strength of the material from which the projectile core 312 is formed, for example, as one factor to help ensure that the projectile fingers 332 splinter or fracture at the appropriate moment after impact of the projectile 30. The conical taper portion 306 may meet the cylindrical anchor pin 308 at an angle $\alpha_3$ of about 115 to 165 degrees, for example, between a surface of the conical taper portion 306 and a surface of the cylindrical anchor pin 308.

Figure 4A:
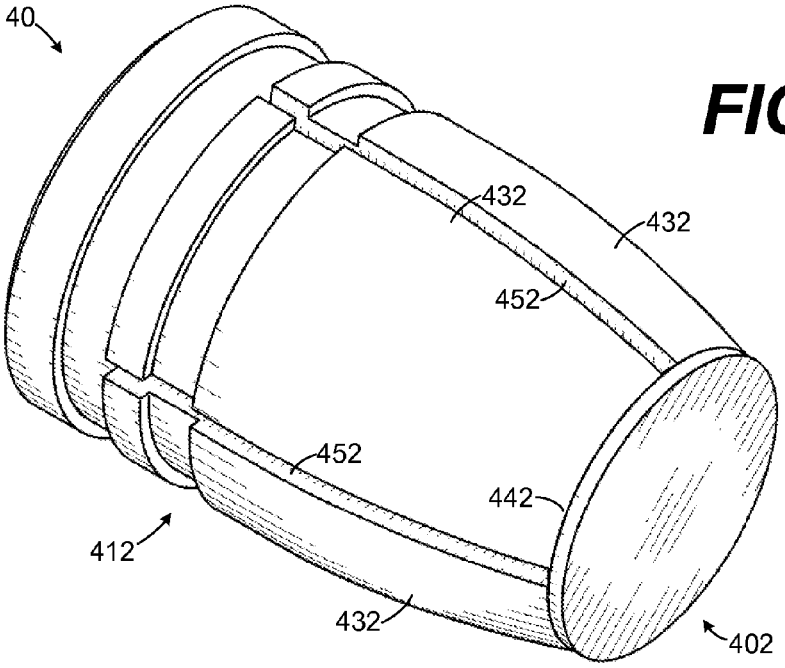
FIGS. 4A-D illustrate front perspective, back perspective, front, and front perspective exploded views of a projectile, respectively, according to another example embodiment.
Figure 4B:
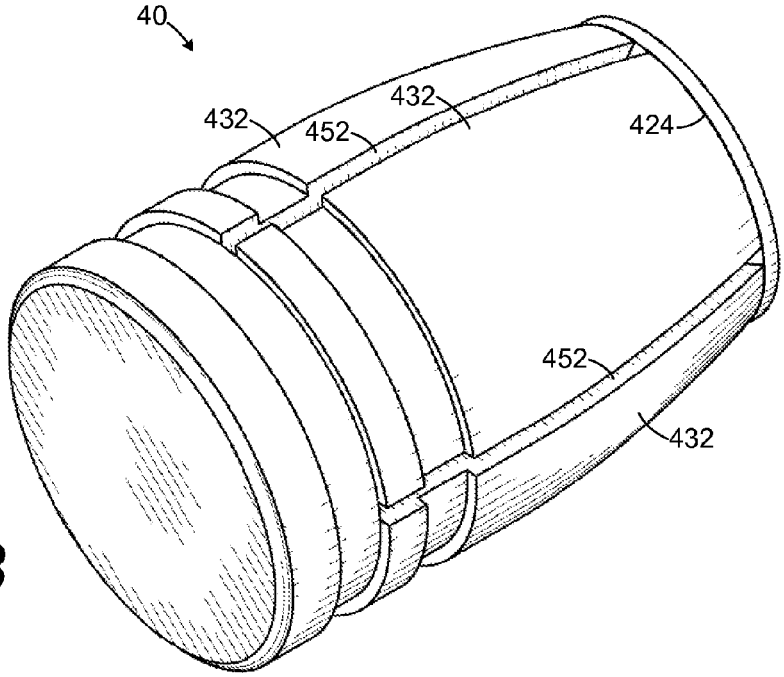
Figure 4C:
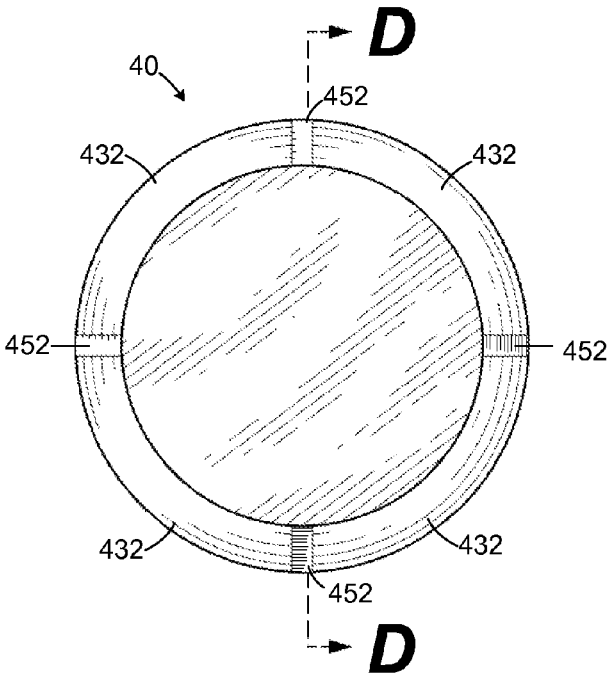
Figure 4D:
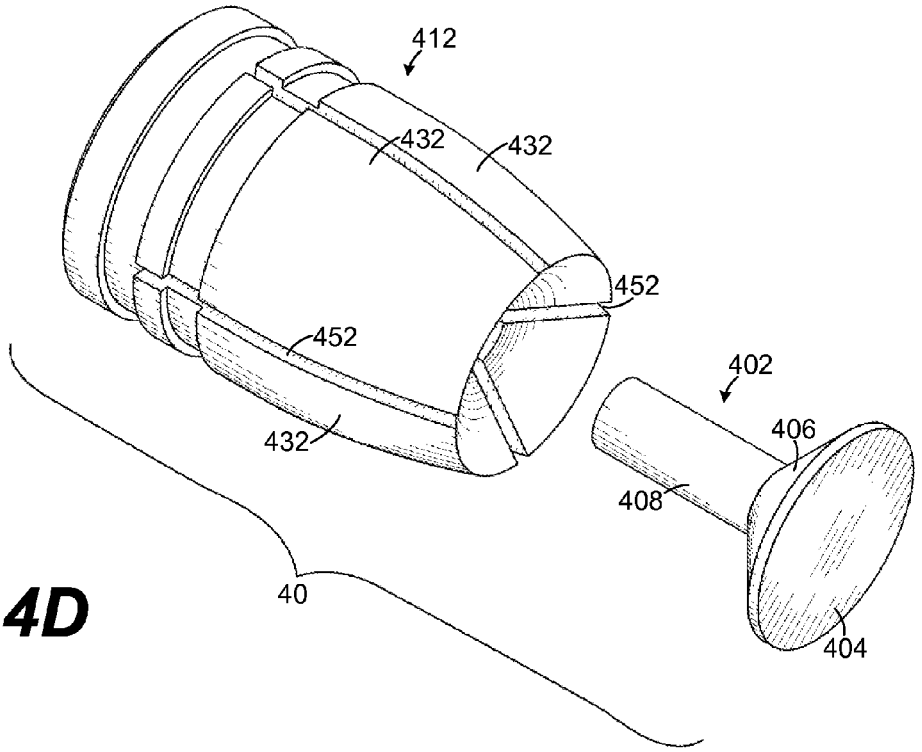
Figure 4E:
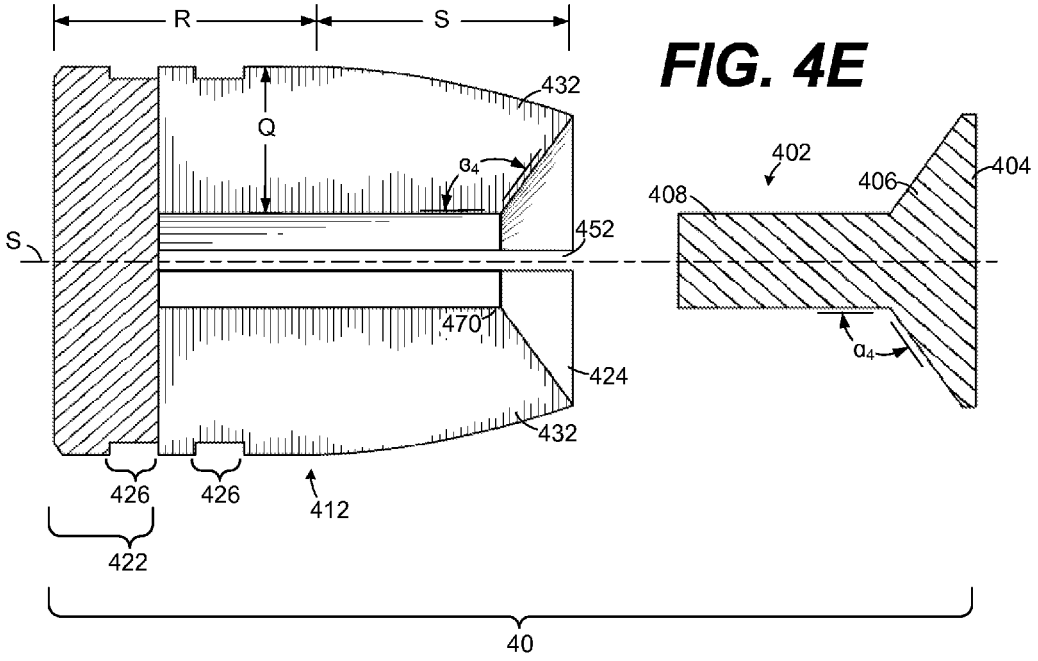
FIG. 4E illustrates a view of the cross section D-D identified in FIG. 4C.

FIGS. 4A-D illustrate front perspective, back perspective, front, and front perspective exploded views of a projectile 40, respectively, according to another example embodiment, and FIG. 4E illustrates a view of the cross section D-D identified in FIG. 4C. As shown among FIGS. 4A-E, the projectile 40 includes a tip 402 and a projectile core 412. The projectile 40 may be similar in sizing or proportions to the commercially-recognized .40 Smith & Wesson caliber projectile. However, among embodiments, the projectile 40 may be embodied as a projectile of another commercially-recognized caliber, including but not limited to .450 Automatic Colt Pistol (ACP), 9 millimeter, .380 ACP, or .357 Magnum, among other commercially-recognized or custom calibers. It should be appreciated that the shape, size, dimensions, and proportions of the projectile 40 in FIGS. 4A-E are not necessarily drawn precisely to scale and should not be considered to limit or define the scope of the embodiments described herein. The projectile core 412 may be formed from any material or materials suitable for the application, including but not limited to those described above for the projectile core 112 in FIG. 1A. The tip 402 may also be formed from any material suitable for the application, including but not limited to those described above for the tip 102 in FIG. 1A.

Referring among FIGS. 4A-E, the projectile core 412 includes a core base 422 (FIG. 4E), undercuts 426, and projectile fingers 432 separated from each other by kerfs 452. As compared to the projectile 10, the projectile 40 includes four projectile fingers 432 rather than six. The undercuts 426 may be included to facilitate suitable splintering or fracturing of the projectile fingers 432 apart from each other after impact of the projectile 40, although they may be omitted.

As illustrated among FIGS. 4A-E, each kerf 452 extends from the leading circumferential rim 424 substantially to the core base 422 (or near the core base 422) of the projectile core 412. The kerfs 452 may extend from the leading circumferential rim 424, to or toward the core base 422, and entirely or partially across the undercut 426. The distance that the kerfs 452 extend may vary, but the kerfs 452 generally extend deep enough into the projectile core 412 so that the projectile core 412 will fracture apart upon impact of the projectile 40, without leaving any remaining slug.

Referring to FIG. 4D, the tip 402 is removed from the projectile core 412 and the features of the tip 402 are illustrated in further detail. According to the concepts described herein, the tip 402 may act as a type of lever to expand fingers of the projectile core 412 upon impact of the projectile 40 with a surface or body. The tip 402 includes a flat-shaped nose 404, a conical taper portion 406, and a cylindrical anchor pin 408. Generally, the shape of the tip 402 corresponds to or mates with the central recess within the projectile core 412. The length of the cylindrical anchor pin 408 may vary among embodiments. In one embodiment, the cylindrical anchor pin 408 may be formed to have sufficient length to fit snugly into the central recess within the projectile core 412 and be retained therein by way of friction, but other considerations may be accounted for.

FIG. 4E illustrates the cross section D-D identified in FIG. 4C. In FIG. 4E, the central recess of the projectile 40 is visible. As shown, the central recess of the projectile core 412 includes a cylindrical recess portion and a conical recess portion. As described above, when assembled, the cylindrical anchor pin 408 of the tip 402 is inserted into and occupies at least part of the cylindrical recess portion, and the conical taper portion 406 of the tip 402 fits within and occupies at least part of the conical recess portion.

As also shown in FIG. 4E, the profile of the inside surfaces of the projectile fingers 432 track the axis of symmetry "S" of the projectile 40 along the cylindrical recess portion, but makes a corner at the transition point 470 between the cylindrical recess portion and the conical recess portion. At the transition point 470, the inside surfaces of the projectile fingers 432 turn at the angle $\beta_4$ with respect to the axis of symmetry "S" and continue for a second distance to the leading circumferential rim 424. As illustrated, the sharpness of the cornered transition point 470 is determined by the angle $\beta_4$. The angle $\beta_4$ between the cylindrical recess portion and the conical recess portion (and the corresponding angle $\alpha_4$ in the tip 402) may be selected based in part on the tensile strength of the material from which the projectile core 412 is formed, for example, to see that the projectile fingers 432 splinter or fracture at the appropriate moment after impact of the projectile 40.

The projectile fingers 432 extend (e.g., occupy the space) radially apart from the axis of symmetry "S" the distance "Q" between the central recess of the projectile core 412 and an outer periphery of the projectile core 412. Further, the projectile fingers 432 extend longitudinally from the leading circumferential rim 424 of the projectile core 412 to the core base 422. The leading circumferential rim 424 may be considered the meplat of the projectile core 412 but is not necessarily the most forward reaching point of the projectile 40. Rather, in the embodiments which include it, the tip 402 is the most forward reaching point of the projectile 40.

The length "R" of the bearing surface and the length "S" of the ogive surface of the projectile core 412 are also shown in FIG. 4E. The individual and relative lengths of the bearing surface and the ogive surface of the projectile core 412 may vary from that shown. In one embodiment, the projectile core 412 may be formed such that the core base 422 is relatively small.

Similar to the case discussed above with reference to FIG. 1H, upon impact of the tip 402 of the projectile 40 with any surface or body, the tip 402 will be pressed further into the central recess within the projectile core 412. At the same time, the conical taper portion 406 of the tip 402 will apply upon the projectile fingers 432 a component of force (at least in part) perpendicular to the axis of symmetry "S" of the projectile 40. In turn, the projectile fingers 432 will bear a force tending to splinter or fracture the projectile fingers 432 apart from each other. When the projectile fingers 432 splinter or fracture, no slug portion of the projectile 40 remains.

The angle $\alpha_4$ between the surfaces of the cylindrical anchor pin 408 and the conical taper portion 406 may be selected based in part on the tensile strength of the material from which the projectile core 412 is formed, for example, as one factor to help ensure that the projectile fingers 432 splinter or fracture at the appropriate moment after impact of the projectile 40. The conical taper portion 406 may meet the cylindrical anchor pin 408 at an angle $\alpha_4$ of about 115 to 165 degrees, for example, between a surface of the conical taper portion 406 and a surface of the cylindrical anchor pin 408.

Figure 5A:
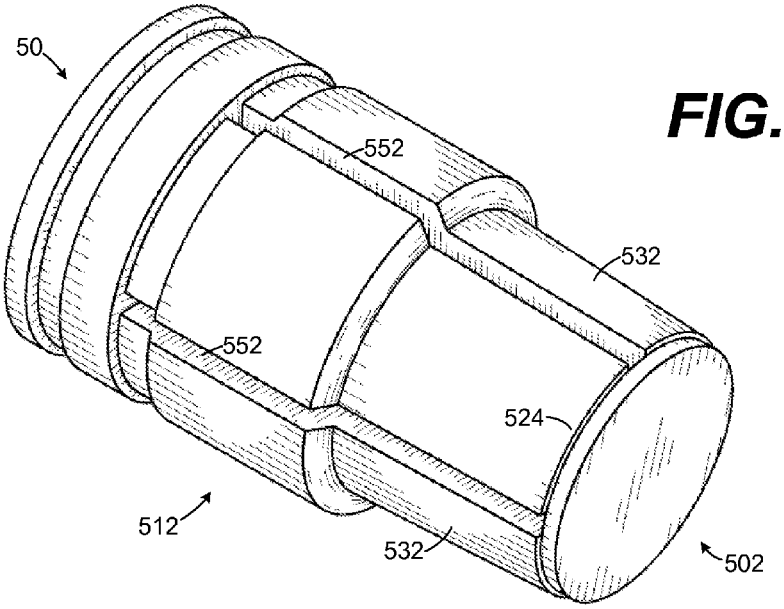
FIGS. 5A-D illustrate front perspective, back perspective, front, and front perspective exploded views of a projectile, respectively, according to another example embodiment.
Figure 5B:
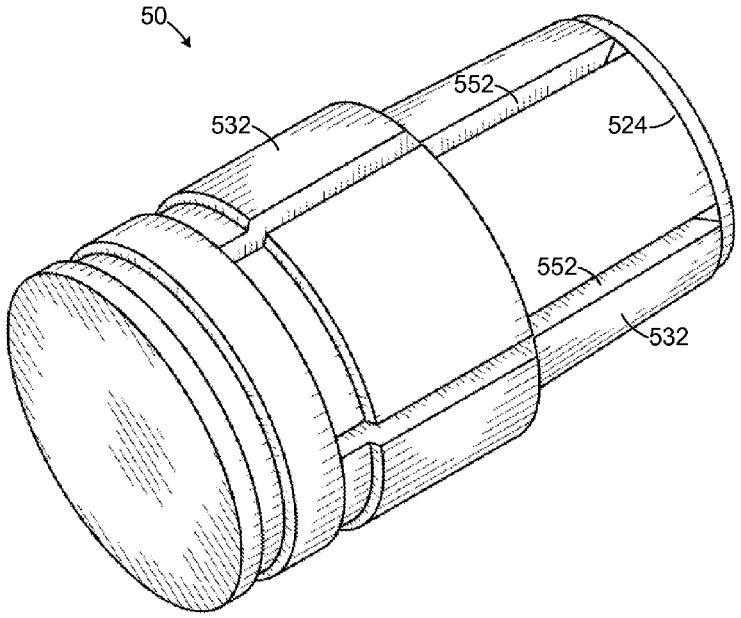
Figure 5C:
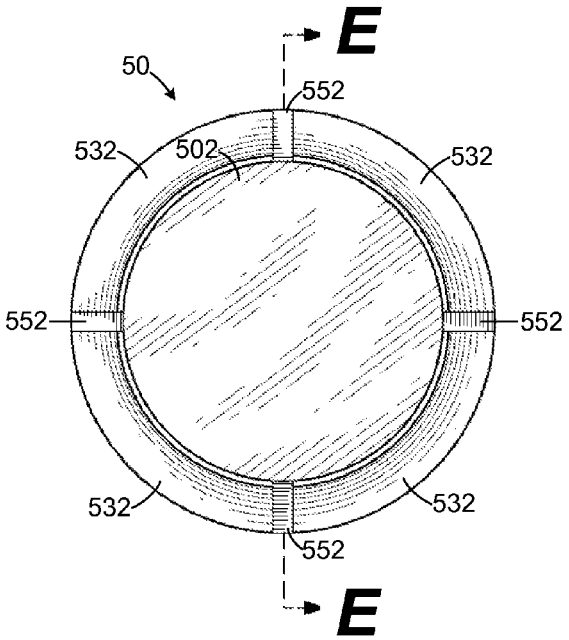
Figure 5D:
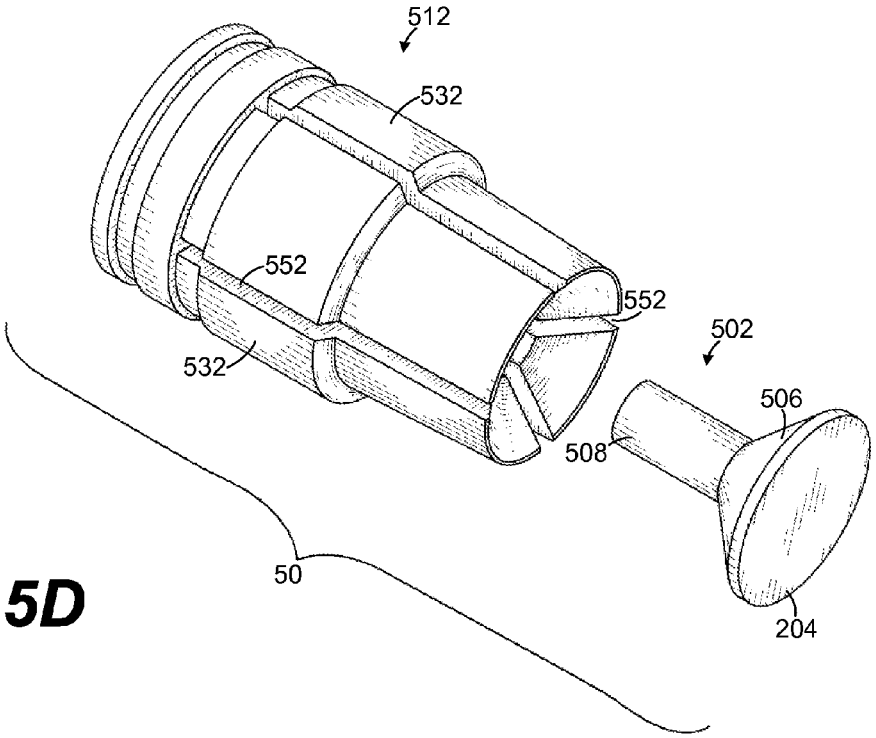
Figure 5E:
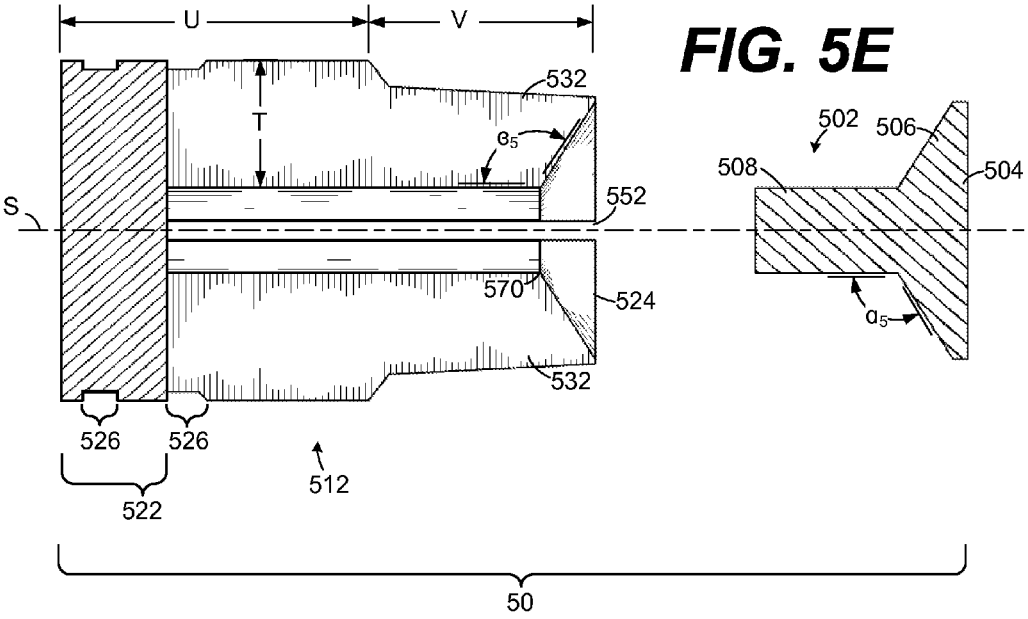
FIG. 5E illustrates a view of the cross section E-E identified in FIG. 5C.

FIGS. 5A-D illustrate front perspective, back perspective, front, and front perspective exploded views of a projectile 50, respectively, according to another example embodiment, and FIG. 5E illustrates a view of the cross section E-E identified in FIG. 5C. As shown among FIGS. 5A-E, the projectile 50 includes a tip 502 and a projectile core 512. The projectile 50 may be similar in sizing or proportions to the commercially-recognized .357 Magnum caliber projectile. However, among embodiments, the projectile 50 may be embodied as a projectile of another commercially-recognized caliber, including but not limited to .450 Automatic Colt Pistol (ACP), 9 millimeter, .380 ACP, or .40 Smith & Wesson, among other commercially-recognized or custom calibers. It should be appreciated that the shape, size, dimensions, and proportions of the projectile 50 in FIGS. 5A-E are not necessarily drawn precisely to scale and should not be considered to limit or define the scope of the embodiments described herein. The projectile core 512 may be formed from any material or materials suitable for the application, including but not limited to those described above for the projectile core 112 in FIG. 1A. The tip 502 may also be formed from any material suitable for the application, including but not limited to those described above for the tip 102 in FIG. 1A.

Referring among FIGS. 5A-E, the projectile core 512 includes a core base 522 (FIG. 5E), undercuts 526, and projectile fingers 532 separated from each other by kerfs 552. As compared to the projectile 10, the projectile 50 includes four projectile fingers 532 rather than six. The undercuts 526 may be included to facilitate suitable splintering or fracturing of the projectile fingers 532 apart from each other after impact of the projectile 50, although it may be omitted.

As illustrated among FIGS. 5A-E, each kerf 552 extends from the leading circumferential rim 524 substantially to the core base 522 (or near the core base 522) of the projectile core 512. The kerfs 552 may extend from the leading circumferential rim 524, to or toward the core base 522, and entirely or partially across the undercut 526. The distance that the kerfs 552 extend may vary, but the kerfs 552 generally extend deep enough into the projectile core 512 so that the projectile core 512 will fracture apart upon impact of the projectile 50, without leaving any remaining slug.

Referring to FIG. 5D, the tip 502 is removed from the projectile core 512 and the features of the tip 502 are illustrated in further detail. According to the concepts described herein, the tip 502 may act as a type of lever to expand fingers of the projectile core 512 upon impact of the projectile 50 with a surface or body. The tip 502 includes a flat-shaped nose 504, a conical taper portion 506, and a cylindrical anchor pin 508. Generally, the shape of the tip 502 corresponds to or mates with the central recess within the projectile core 512. The length of the cylindrical anchor pin 508 may vary among embodiments. In one embodiment, the cylindrical anchor pin 508 may be formed to have sufficient length to fit snugly into the central recess within the projectile core 512 and be retained therein by way of friction, but other considerations may be accounted for.

FIG. 5E illustrates the cross section E-E identified in FIG. 5C. In FIG. 5E, the central recess of the projectile 50 is visible. As shown, the central recess of the projectile core 512 includes a cylindrical recess portion and a conical recess portion. As described above, when assembled, the cylindrical anchor pin 508 of the tip 502 is inserted into and occupies at least part of the cylindrical recess portion, and the conical taper portion 506 of the tip 502 fits within and occupies at least part of the conical recess portion.

As also shown in FIG. 5E, the profile of the inside surfaces of the projectile fingers 532 track the axis of symmetry "S" of the projectile 50 along the cylindrical recess portion but makes a corner at the transition point 570 between the cylindrical recess portion and the conical recess portion. At the transition point 570, the inside surfaces of the projectile fingers 532 turn at the angle $\beta_5$ with respect to the axis of symmetry "S" and continue for a second distance to the leading circumferential rim 524. As illustrated, the sharpness of the cornered transition point 570 is determined by the angle $\beta_5$. The angle $\beta_5$ between the cylindrical recess portion and the conical recess portion (and the corresponding angle $\alpha_5$ in the tip 502) may be selected based in part on the tensile strength of the material from which the projectile core 512 is formed, for example, to see that the projectile fingers 532 splinter or fracture at the appropriate moment after impact of the projectile 50.

The projectile fingers 532 extend (e.g., occupy the space) radially apart from the axis of symmetry "S" the distance "T" between the central recess of the projectile core 512 and an outer periphery of the projectile core 512. Further, the projectile fingers 532 extend longitudinally from the leading circumferential rim 524 of the projectile core 512 to the core base 522. The leading circumferential rim 524 may be considered the meplat of the projectile core 512 but is not necessarily the most forward reaching point of the projectile 50. Rather, in the embodiments which include it, the tip 502 is the most forward reaching point of the projectile 50.

The length "U" of the bearing surface and the length "V" of the tapered nose surface of the projectile core 512 are also shown in FIG. 5E. The individual and relative lengths of the boat tail, the bearing surface, and the ogive surface of the projectile core 512 may vary from that shown. In one embodiment, the projectile core 512 may be formed such that the core base 522 is relatively small.

Similar to the case discussed above with reference to FIG. 1H, upon impact of the tip 502 of the projectile 50 with any surface or body, the tip 502 will be pressed further into the central recess within the projectile core 512. At the same time, the conical taper portion 506 of the tip 502 will apply upon the projectile fingers 532 a component of force (at least in part) perpendicular to the axis of symmetry "S" of the projectile 50. In turn, the projectile fingers 532 will bear a force tending to splinter or fracture the projectile fingers 532 apart from each other. When the projectile fingers 532 splinter or fracture, no slug portion of the projectile 50 remains.

The angle $\alpha_5$ between the surfaces of the cylindrical anchor pin 508 and the conical taper portion 506 may be selected based in part on the tensile strength of the material from which the projectile core 512 is formed, for example, as one factor to help ensure that the projectile fingers 532 splinter or fracture at the appropriate moment after impact of the projectile 50. The conical taper portion 506 may meet the cylindrical anchor pin 508 at an angle $\alpha_5$ of about 115 to 165 degrees, for example, between a surface of the conical taper portion 506 and a surface of the cylindrical anchor pin 508.

Figure 6:
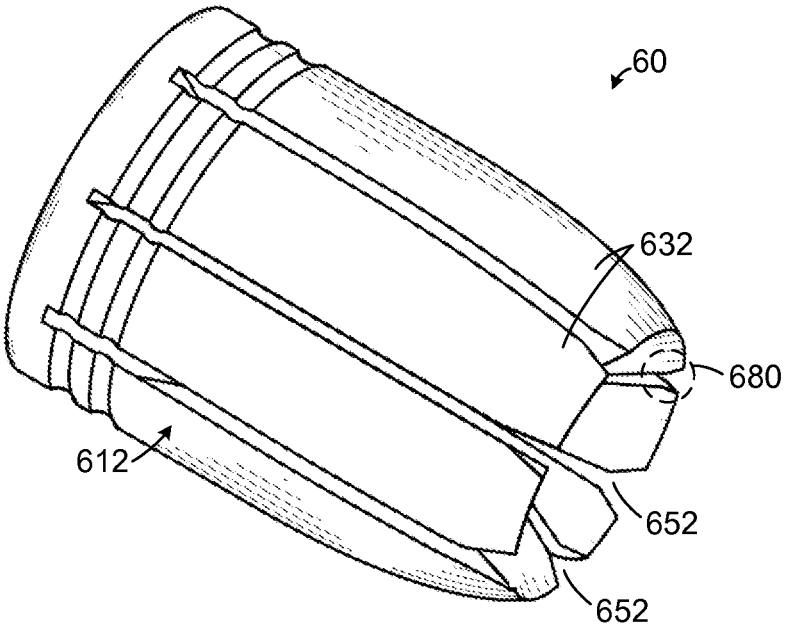
FIG. 6 illustrates a front perspective view a projectile according to another example embodiment.

FIG. 6 illustrates a front perspective view of a projectile 60 according to still another example embodiment. In the embodiment illustrated in FIG. 6, at the distal end of each kerf 652, a tapered notch 680 is formed or cut between each of the projectile fingers 632. In alternative embodiments, the tapered notches 680 may be rounded or cause the projectile fingers 632 to be rounded or pointed at the forward end. The tapered notches may also extend further down each kerf 652 in other embodiments.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

At least the following is claimed:

1. A projectile, comprising:

a projectile core having a central recess formed therein, the central recess including a conical recess portion and a cylindrical recess portion, the projectile core comprising:

a core base, wherein the central recess extends from a circumferential meplat rim of the projectile core to the core base along an axis of symmetry of the projectile core; and a plurality of projectile fingers each separated by a kerf, the plurality of projectile fingers extending longitudinally from the core base to the circumferential meplat rim, extending radially away from the axis of symmetry between the central recess and an outer periphery surface of the projectile core, and transitioning at an angle between the conical recess portion and the cylindrical recess portion; and a tip including a nose, a conical taper portion, and a cylindrical anchor pin, the tip transitioning at an angle between the conical taper portion and the cylindrical anchor pin of the tip, wherein the angle between the conical recess portion and the cylindrical recess portion of the projectile core is substantially equivalent to the angle between the conical taper portion and the cylindrical anchor pin of the tip;

each of the plurality of projectile fingers includes a plurality of surfaces, at least two of the plurality of surfaces are substantially flat, at least another two of the plurality of surfaces are curved, and along the axis of symmetry, the core base extends less than thirty percent of a length of the projectile core such that, upon impact of the projectile, the entire core base fractures into a plurality of sections along with the plurality of projectile fingers.

2. The projectile according to claim 1, wherein the cylindrical anchor pin of the tip is lodged inside the cylindrical recess portion of the central recess, and the conical taper portion of the tip substantially occupies the conical recess portion of the central recess.

3. The projectile according to claim 1, wherein:

an inner surface of each of the plurality of projectile fingers includes a partial conical surface along the central recess; and an outer periphery surface of each of the plurality of projectile fingers includes a length of bearing surface and a length of ogive surface.

4. The projectile according to claim 1, wherein the projectile core is formed from a single piece of stock material.

5. The projectile according to claim 4, wherein the projectile core is formed from brass or bronze and the core base fractures into sections along with the plurality of projectile fingers upon impact of the projectile.

6. The projectile according to claim 1, wherein the nose of the tip is substantially semispherical.

7. The projectile according to claim 1, wherein the nose of the tip is substantially flat.

8. The projectile according to claim 1, wherein the core base fractures into sections along with the plurality of projectile fingers upon impact of the projectile.

9. The projectile according to claim 1, wherein the angle between conical taper portion and the cylindrical anchor pin of the tip is about 135 degrees.

10. A projectile, comprising:

a projectile core having a central recess formed therein, the central recess including a conical recess portion and a cylindrical recess portion, the projectile core comprising:

a core base, wherein the central recess extends from a circumferential meplat rim of the projectile core to the core base along an axis of symmetry of the projectile core; and a plurality of projectile fingers separated from each other, the plurality of projectile fingers extending longitudinally from the core base to the circumferential meplat rim and transitioning at an angle between the conical recess portion and the cylindrical recess portion; and a tip including a nose, a conical taper portion, and a cylindrical anchor pin, the tip transitioning at an angle between the conical taper portion and the cylindrical anchor pin, wherein the angle between the cylindrical recess portion and the conical recess portion of the projectile core is substantially equivalent to the angle between the conical taper portion and the cylindrical anchor pin of the tip;

each of the plurality of projectile fingers includes a plurality of surfaces, at least two of the plurality of surfaces are substantially flat, at least another two of the plurality of surfaces are curved, and along the axis of symmetry, the core base extends less than thirty percent of a length of the projectile core such that, upon impact of the projectile, the entire core base fractures into a plurality of sections along with the plurality of projectile fingers.

11. The projectile according to claim 10, wherein the plurality of projectile fingers extend radially away from the axis of symmetry between the central recess and an outer periphery surface of the projectile core.

12. The projectile according to claim 10, wherein the conical taper portion of the tip substantially occupies the conical recess portion of the central recess.

13. The projectile according to claim 10, wherein the projectile core further comprises a plurality of undercuts about an outer periphery of the projectile core, and a kerf separates each of the plurality of projectile fingers and extends longitudinally from the circumferential meplat rim of the projectile core toward the core base and across at least one of the plurality of undercuts.

14. A projectile, comprising:

a projectile core having a central recess formed therein, the central recess including a conical recess portion and a cylindrical recess portion, the projectile core comprising:

a core base, wherein the central recess extends from a circumferential meplat rim of the projectile core to the core base along an axis of symmetry of the projectile core; and a plurality of projectile fingers separated from each other, the plurality of projectile fingers extending longitudinally from the core base to the circumferential meplat rim and transitioning at an angle between the conical recess portion and the cylindrical recess portion; and a tip including a nose, a conical taper portion, and a cylindrical anchor pin, the tip transitioning at an angle between the conical taper portion and the cylindrical anchor pin, wherein the projectile core is formed from a single piece of brass or bronze stock material, each of the plurality of projectile fingers includes a partial conical surface, the angle between the cylindrical recess portion and the conical recess portion of the projectile core is substantially equivalent to the angle between the conical taper portion and the cylindrical anchor pin of the tip, and along the axis of symmetry, the core base extends less than thirty percent of a length of the projectile core such that, upon impact of the projectile, the entire core base fractures into a plurality of sections along with the plurality of projectile fingers.

15. The projectile according to claim 14, wherein the plurality of projectile fingers extend radially away from the axis of symmetry between the central recess and an outer periphery surface of the projectile core.

16. The projectile according to claim 14, wherein the conical taper portion of the tip substantially occupies the conical recess portion of the central recess.

* * * * *